US005725002A

United States Patent [19]

Payzant

[11] Patent Number: 5,725,002

[45] Date of Patent: Mar. 10, 1998

[54] DISH WASHING MACHINE HAVING INTERCHANGEABLE TOP AND BOTTOM SPRAY ARMS

[75] Inventor: Russell L. Payzant, Olathe, Kans.

[73] Assignee: TCA, Inc., Kansas City, Kans.

[21] Appl. No.: 685,497

[22] Filed: Jul. 24, 1996

[51] Int. Cl.[6] ..... A47L 15/23

[52] U.S. Cl. ..... 134/95.3; 134/104.1; 134/104.4; 134/111; 134/175; 134/176; 134/179; 239/245; 239/248; 239/261

[58] Field of Search ..... 134/95.3, 104.1, 134/104.2, 104.4, 111, 175, 176, 177, 179, 180; 239/245, 248, 261, 264

[56] References Cited

U.S. PATENT DOCUMENTS

| | | | |
|---|---|---|---|
| 1,495,473 | 5/1924 | Fitzgerald | 134/111 X |
| 1,620,671 | 3/1927 | Merseles | 134/176 X |
| 1,645,227 | 10/1927 | Cease | 134/176 |
| 1,675,192 | 6/1928 | Murdoch | 134/176 |
| 1,823,583 | 9/1931 | Biskamp | 134/177 |
| 2,071,036 | 2/1937 | Johnston | 134/176 X |
| 2,704,082 | 3/1955 | Jackson | 134/95.3 |
| 4,228,813 | 10/1980 | Noren | 134/104.1 X |
| 4,869,428 | 9/1989 | Gombar | 134/179 X |

FOREIGN PATENT DOCUMENTS

| | | | |
|---|---|---|---|
| 621747 | 5/1927 | France | 134/179 |
| 797889 | 2/1936 | France | 134/176 |
| 1957141 | 2/1971 | Germany | 134/176 |

*Primary Examiner*—Philip R. Coe

*Attorney, Agent, or Firm*—Kokjer, Kircher, Bowman & Johnson

[57] ABSTRACT

A dish washing machine having upper and lower spray assemblies with separate spray arms and separate water supplies for washing and rinsing dishware. A spray base for each spray assembly segregates recycled wash water from clean incoming rinse water. A hollow drum mounted to each manifold has side discharge openings. A ball bearing assembly mounts the wash spray arms for rotation about the drums. A conduit for the rinse water extends through each drum and connects with a spindle on which the rinse spray arms are mounted for rotation. The upper and lower spray arm assemblies are interchangeable. The bearing assembly is uniquely constructed such that it is automatically flushed with clean rinse water during each cycle of operation.

14 Claims, 5 Drawing Sheets

DISH WASHING MACHINE HAVING INTERCHANGEABLE TOP AND BOTTOM SPRAY ARMS

FIELD OF THE INVENTION

This invention relates generally to the washing of objects such as dishes and deals more particularly with a dish washing machine in which interchangeable top and bottom spray assemblies are rotatively supported in a unique manner that prolongs their useful life and facilitates maintenance operations.

BACKGROUND OF THE INVENTION

Dish washing machines that are used in restaurants and other commercial and institutional applications face particularly troublesome operating conditions. The dishware they handle is often precleaned in only a cursory manner if at all, and it is common for a variety of food remnants and other materials to be introduced into the machine along with the dishware. These materials can clog up the spray system of the machine and cause problems such as ineffective cleaning and undue machine downtime. Routine servicing and maintenance of the spray assemblies is also required at frequent intervals to maintain the components in good operating condition.

The rotating spray arms that apply the wash spray require bearings, arms or bushings allowing them to turn as they spray wash water onto the dishes. The debris that enters the machine can easily contaminate the bearings and cause them to fail prematurely. This adds both to the costs and to the downtime of the machine.

The operators of commercial and institutional dish washing machines generally have relatively low levels of skill. Consequently, the maintenance procedures must be such that they can be carried out without requiring significant mechanical aptitude. Likewise, the parts that require routine servicing must be easily disassembled and reassembled following maintenance operations. It is normal for the water to be sprayed both from above and below the dishes. In large part because of the low skill level of most operators, the parts of the top and bottom spray assemblies should be interchangeable so that they can be reassembled without the need to differentiate between the components of the upper and lower assemblies.

SUMMARY OF THE INVENTION

The present invention is directed to an improved dish washing machine which is constructed particularly for use in commercial and institutional type applications where harsh operating conditions and frequent use are common.

More particularly, the dish washing machine of the present invention has uniquely constructed spray arm assemblies arranged with wash spray arms located both above and below the dishes and with rinse spray arms located both above and below the dishes. In accordance with the invention, the dishes which are to be washed are delivered to a wash compartment that is located within a cabinet of the machine. The water that is sprayed onto the dishes collects in a tank underlying the wash compartment, and this water is reused as the wash water for the next wash cycle. The rinse water is separately supplied from a source of clean water, and it also collects in the tank thus raising the water level therein to a point where the tank overflows to a drain system. The water which overflows the tank carries with it whatever floating debris may have been introduced into the machine. Debris is removed in this way to maintain the wash water in a cleaner condition.

The spray arms are characterized by a unique construction which provides for easy maintenance, reliable operation, and segregation of the clean rinse water from the wash water. Both the top and bottom wash spray assemblies have essentially the same construction, and all of the components are interchangeable.

Each spray assembly includes a spray base secured to the machine cabinet and provided with separate inlets for the wash and rinse water. A hollow drum or dome is mounted on each spray base. The wash water is delivered to the interior of each drum and is discharged sidewardly through discharge ports located in the side wall of the drum. A wash spray assembly which is mounted to turn around each drum includes a hub that is located adjacent to the drum wall. Each hub carries a plurality of radially extending spray arms which receive the wash water as the hub turns and spray the water toward the dishware in the cabinet.

The rinse water flow path includes a vertical conduit which extends through each drum and receives the rinse water from the manifold. A pivot or spindle is threaded to each conduit and forms an extension of the conduit located exteriorly of the drum. A rinse spray arm assembly is mounted on the end of each spindle to spray rinse water onto the dishware following the end of each wash cycle.

The wash spray assemblies are rotatively supported by means of a unique bearing construction. Each bearing is supported on a collar which projects from each of the spindles. The shell of each bearing is secured to the hub such that the hub is supported to rotate around the drum in the proper position and orientation. This arrangement provides precise and reliable rotative support for the wash arms, allows easy detachment of the wash arms and related components for maintenance, accommodates interchangeable top and bottom spray arms, and assures that the wash arms are properly located to receive the incoming wash water directly from the hubs in a lateral direction to avoid inefficiencies in the water delivery.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
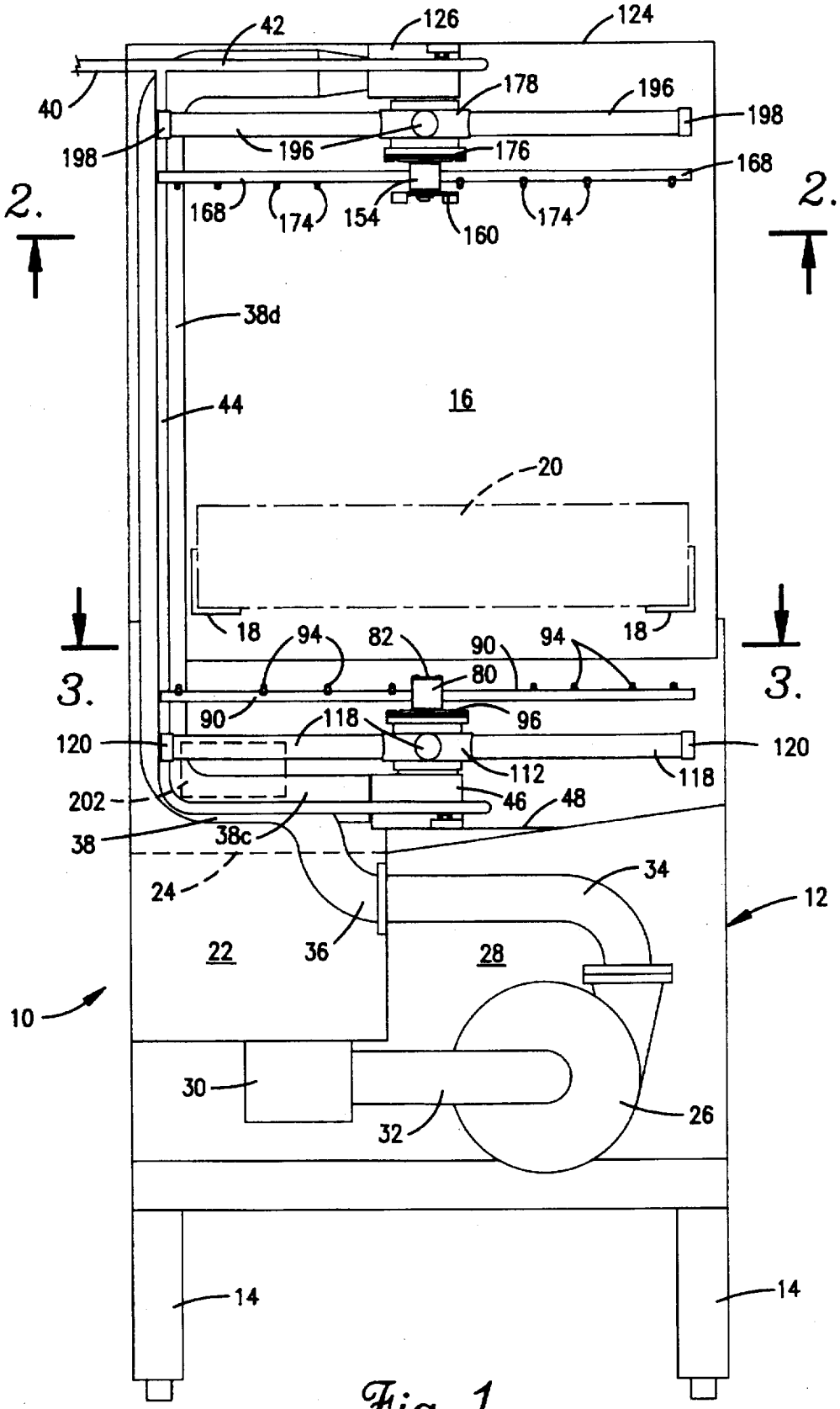
FIG. 1 is an elevational view of a dish washing machine constructed according to a preferred embodiment of the present invention, with broken lines depicting a rack of dishes loaded into the machine.

Referring now to the drawings in more detail and initially to FIG. 1, numeral 10 general designates a dish washing machine constructed in accordance with the preferred embodiment of the present invention. The machine 10 has a cabinet 12 supported on legs 14. The cabinet 12 provides on its upper portion a generally rectangular wash compartment 16 in which racks of dishes may be washed and rinsed. In the lower portion of the wash compartment 16, the cabinet is provided with a pair of angles 18 on which a rack 20 holding dishes may be supported. A hood (not shown) may be closed in order to enclose the rack 20 within the compartment 16 when the machine is to be operated. The cabinet is preferably constructed of stainless steel components.

Figure 3:
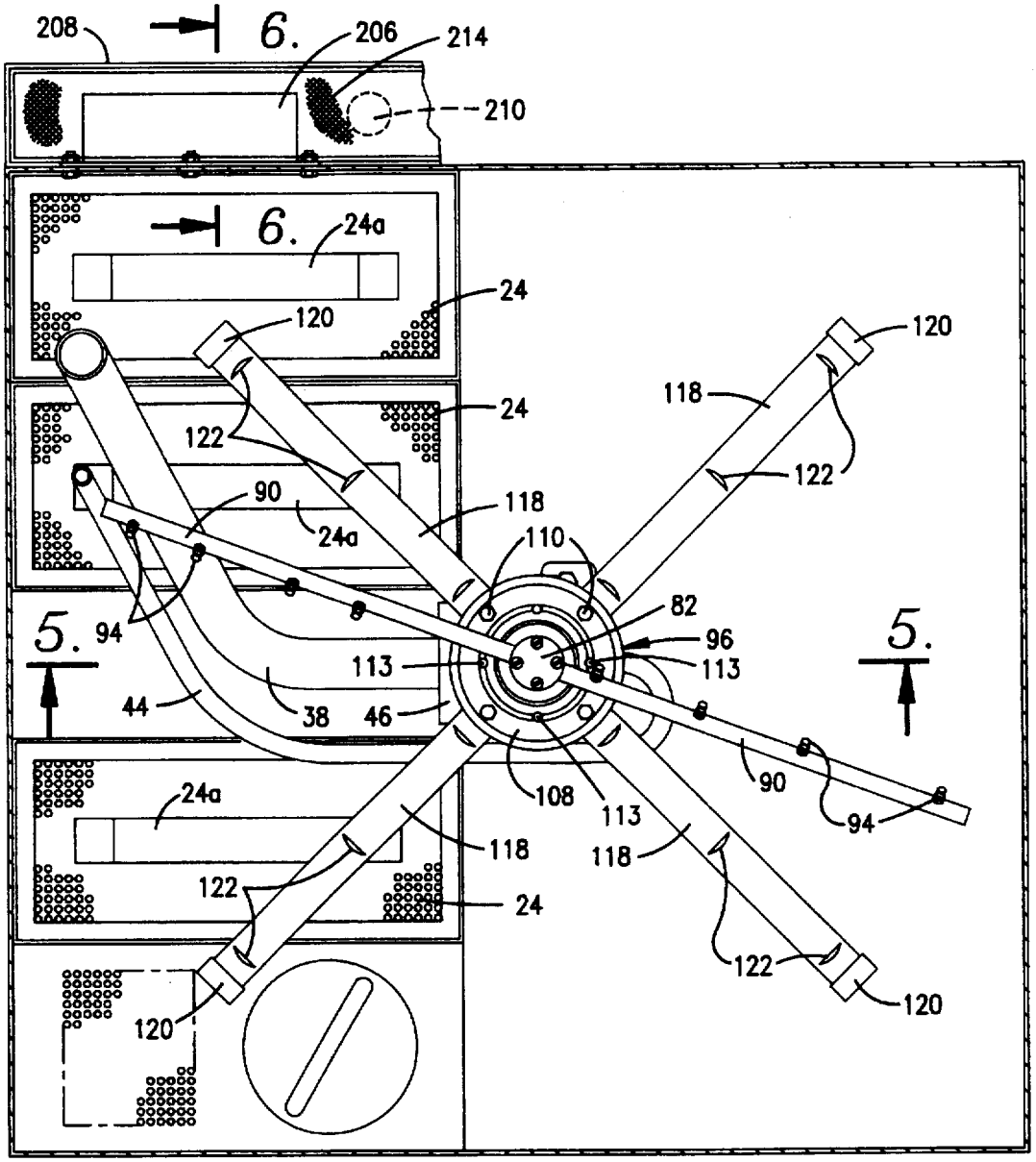
FIG. 3 is a fragmentary sectional view taken generally along line 3—3 of FIG. 1 in the direction of the arrows.

A sump 22 is located beneath the wash compartment 16 for collecting the wash and rinse water that is sprayed onto the dishware in the wash compartment. A plurality of screens 24 overlie the sump 22 in order to prevent large particulate matter from entering the sump. As best shown in FIG. 3, each screen 24 is provided with a handle **24*a* which facilitates lifting of the screens during cleaning of the machine. The screens 24** collect scrap material that sinks and can be dislodged from the screens when they are cleaned.

Referring again to FIG. 1 in particular, a pump 26 is mounted in an enclosed compartment 28 formed in the lower portion of the cabinet 12. A fitting 30 is located beneath the sump 22. Extending from the fitting 30 to the intake side of pump 26 is a conduit 32 which allows the water which is collected in the sump 22 to be reused during the next wash cycle. The discharge side of the pump 26 connects with a curved conduit 34. Conduit 34 connects through a side wall of the sump 22 with a short conduit 36. Conduit 36 in turn connects with another conduit 38. When the pump 26 is operated, the water that collects in the sump 22 is pumped to the conduit 38 for use as wash water during the next cycle of the machine.

The conduit 38 has a horizontal portion **38*c* and a vertical portion 38*d*. Conduit 36 connects with the horizontal portion 38*c* at an angle causing the water to flow to the vertical portion 38*d* which supplies the upper wash arm assembly. The angle at which conduit 36 connects with conduit 38** causes the pressure to be greater at the top wash assembly than at the bottom wash assembly.

with continued reference to FIG. 1 in particular, the machine 10 is supplied with clean rinse water which is delivered to a supply line 40. The supply line 40 connects with a suitable source of incoming clean water such as the plumbing supply lines of a building which is supplied with city water. The supply conduit 40 branches to connect with a horizontal conduit 42 and a vertical conduit 44 which extends downwardly and is turned sidewardly at a location below the wash compartment 16.

Figure 5:
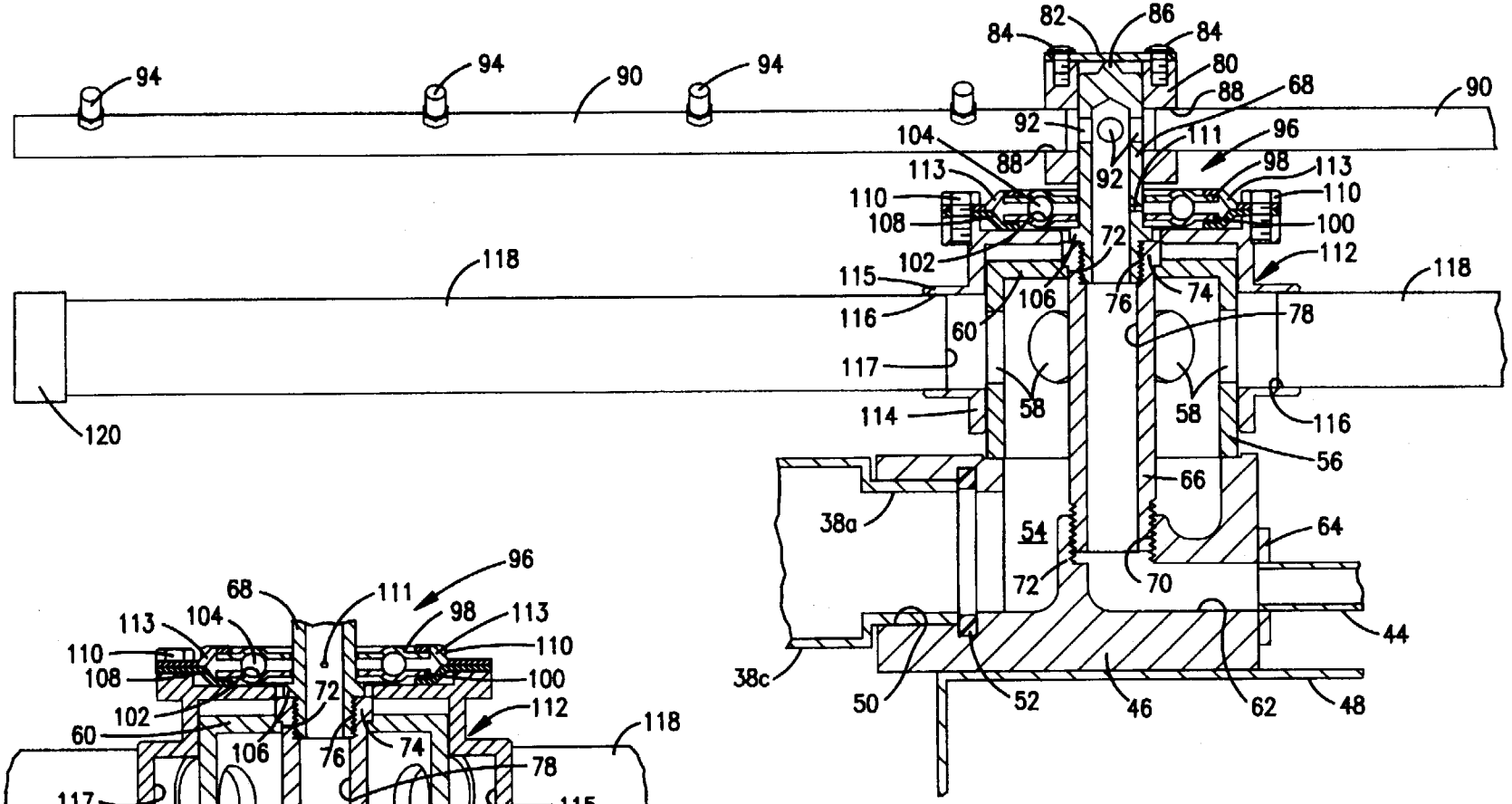
FIG. 5 is a fragmentary sectional view on an enlarged scale taken generally along line 5—5 of FIG. 3 in the direction of the arrows.
Figure 7:
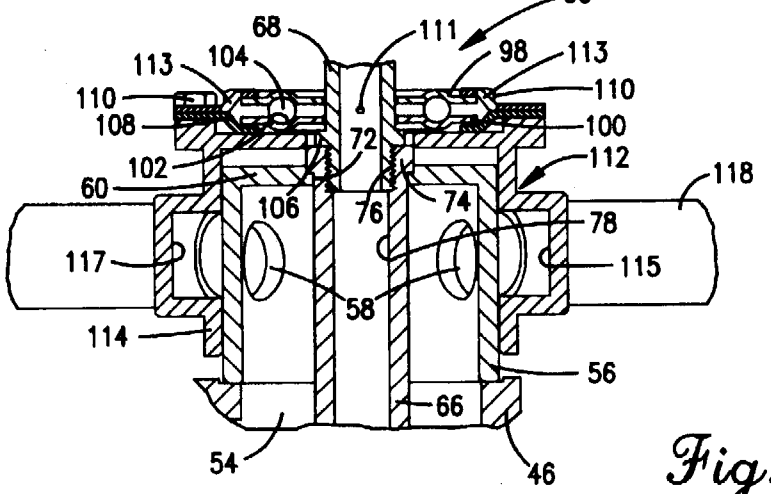
FIG. 7 is a fragmentary sectional view on an enlarged scale taken generally along line 7—7 of FIG. 2 in the direction of the arrows.

The machine 10 is equipped with upper and lower spray assemblies which apply the wash water and rinse water to the dishes loaded into the wash compartment 16. The lower spray assembly is best illustrated in FIGS. 5 and 7. A spray base 46 is mounted on top of a horizontal panel 48 which is located on the cabinet below the wash compartment. The spray base 46 has an inlet 50 which receives the incoming wash water supplied through the horizontal conduit portion **38*c*. Conduit 38 has a reduced diameter end 38*a* which is fitted closely in the inlet 50 and butted against an O-ring 52 which is secured in the spray base 46. The wash water inlet 50 leads to a chamber 54 formed in the spray base 46**.

A hollow dome or drum 56 is mounted on top of the spray base 46 with the hollow interior of the drum registering with the chamber 54 of the spray base. The wash water that is delivered to the chamber 54 passes into the hollow interior of drum 56. The drum 56 has a cylindrical wall which presents a plurality of side discharge ports 58 through which the wash water discharges from the drum in a sideward direction. The drum 56 has a circular top panel 60 which is oriented in horizontal plane.

With particular reference to FIG. 5, the spray block 46 has a second inlet 62 which is for receiving the clean incoming rinse water. The end of the conduit 44 has a flange 64 which is bolted or otherwise connected with the spray base such that the conduit 44 registers with the inlet 62. The inlet 62 is isolated from the other inlet 50 and the internal chamber 54.

A vertical conduit or pipe 66 and a spindle 68 which provides an extension of the pipe 66 cooperate to form a vertical conduit providing a flow path for the rinse water. The lower end of pipe 66 has a threaded connection at 70 with a boss 72 formed internally of the spray base 46. Pipe 66 extends through the drum 56 along the center vertical axis of the drum. Pipe 66 extends through an opening 72 formed in the center of the top panel 60 of drum 56. The top end of pipe 66 is flanged at 74, and the flange 74 is seated on a shoulder provided by a counter bore of the opening 72. This secures the drum 56 in position on top of the spray base 46.

The top end of pipe 66 is internally threaded and has a threaded connection at 76 with the lower end of the spindle 68. The spindle 68 extends upwardly from pipe 66 and forms a continuation or extension of the pipe. The pipe 66 and spindle 68 have axial passages which cooperate to provide a vertical flow passage 78 for the rinse water.

A rinse arm assembly is supported for rotation on top of the spindle 68. The rinse arm assembly has a central hub 80. A circular plate 82 is secured to the top of the hub 80 by screws 84 or other fasteners. The plate 82 rests on a tip 86 which projects from the upper end of the spindle 68. This supports the rinse spray assembly on the spindle for rotation about the center vertical axis of spindle 68. The hub 80 fits closely around the upper portion of the spindle 68.

The hub 80 has two passages 88 which extend laterally or radially through the hub wall at diametrically opposed locations. A pair of rinse spray arms or pipes 90 are secured in the passages 88 and extend laterally or radially outward from the hub 80. Near its upper end, the spindle 68 is provided with four discharge ports 92 which are oriented in a lateral or radial direction and register with the passages 88 when the hub 88 turns on the spindle. The rinse water is thus delivered to the spray arms 90 and is discharged in a series of sprays from nozzles 94 spaced along the length of each spray arm 90.

A lower wash spray arm assembly is supported for rotation by a uniquely constructed bearing assembly which is generally identified by numeral 96. The bearing assembly 96 has upper and lower races 98 and 100 which take the form of generally flat, annular rings. The bearing races 98 and 100 are spaced apart from one another with their facing surfaces deformed in a manner to form a circular track 102 between the races. A plurality of metal balls 104 fit in the track 102 to accommodate relative rotation of the races 98 and 100. The lower race 100 rests on a radially projecting lip or collar 106 which projects from the spindle 68 at a location adjacent to and above the pipe flange 74. The races 98 and 100 extend around the shank of the spindle 68.

The bearing assembly 96 has a shell 108 which takes the form of a two piece unit extending around the peripheral edges of the races 98 and 100. Mating flange portions of the shell pieces are secured to one another by screws 110 which also secure the bearing to a hub 112 forming part of the wash spray arm assembly. The shell 108 serves as a retainer which holds the races 98 and 100 together at their peripheries and retains the balls 104 in the track 102. A small port 111 extends through the wall of spindle 68 at a location between the races 98 and 100. The port 111 directs rinse water from passage 78 into the bearing 96 to flush the bearing out and dislodge any foreign matter that may otherwise tend to degrade the bearing performance.

The top portion of the shell 108 is provided with openings 113 which serve as outlets for water introduced between the races 98 and 100. The openings 113 relieve the hydraulic pressure which otherwise can cause the bearing to lock up and preclude rotation of the spray arms. The openings 113 also allow debris to be flushed out from between the bearing races.

The hub 112 has a wall 114 which fits around the drum 56. The wall 114 is formed with a center portion 115 which extends outwardly and provides an annular channel 117 at a location on the hub 112 which aligns with ports 58. Internally threaded openings 116 are formed through the center portion of the hub wall 114 and communicate with the channel 117. Four spray arms 118 are threaded into or otherwise connected with the openings 116. Each spray arm 118 has a cap 120 on its outer end and a plurality of spray openings 122 (see FIG. 3) which direct the wash spray upwardly toward the dishes in the overlying wash compartment 16. The bearing 96 supports the hub 112 and the depending spray arms 118 for rotation about the common center axis of the drum 56, pipe 66 and spindle 68.

The construction of the bearing assembly 96 is an important feature of the invention. The bearing assembly 96 is a substantially flat structure which is a significant advantage because the height available for the spray assembly is limited. The bearing assembly also provides a "floating" type mounting arrangement for the spray arms in order to accommodate rotation and minimize wear on the components. The shell 108 does not tightly grip the races 98 and 100, so the races have some up and down "play" relative to one another and to the shell. Likewise, the inside edges of the races have some clearance around the spindle 68 and the outside edges of the races have some play relative to the shell 108. Consequently, the races can move to a limited extent relative to one another and to the shell, thus providing a "floating" type mount. This in turn allows the hub 112 to rotate freely around the drum 56. There is sufficient clearance between the walls of the hub and drum to accommodate a thin film of water which reduces the friction between the hub and drum and minimizes wear. At the same time, the flushing system provided for the bearing by port 111 and openings 113 prevents contamination of the bearing by debris in the wash water.

Figure 4:
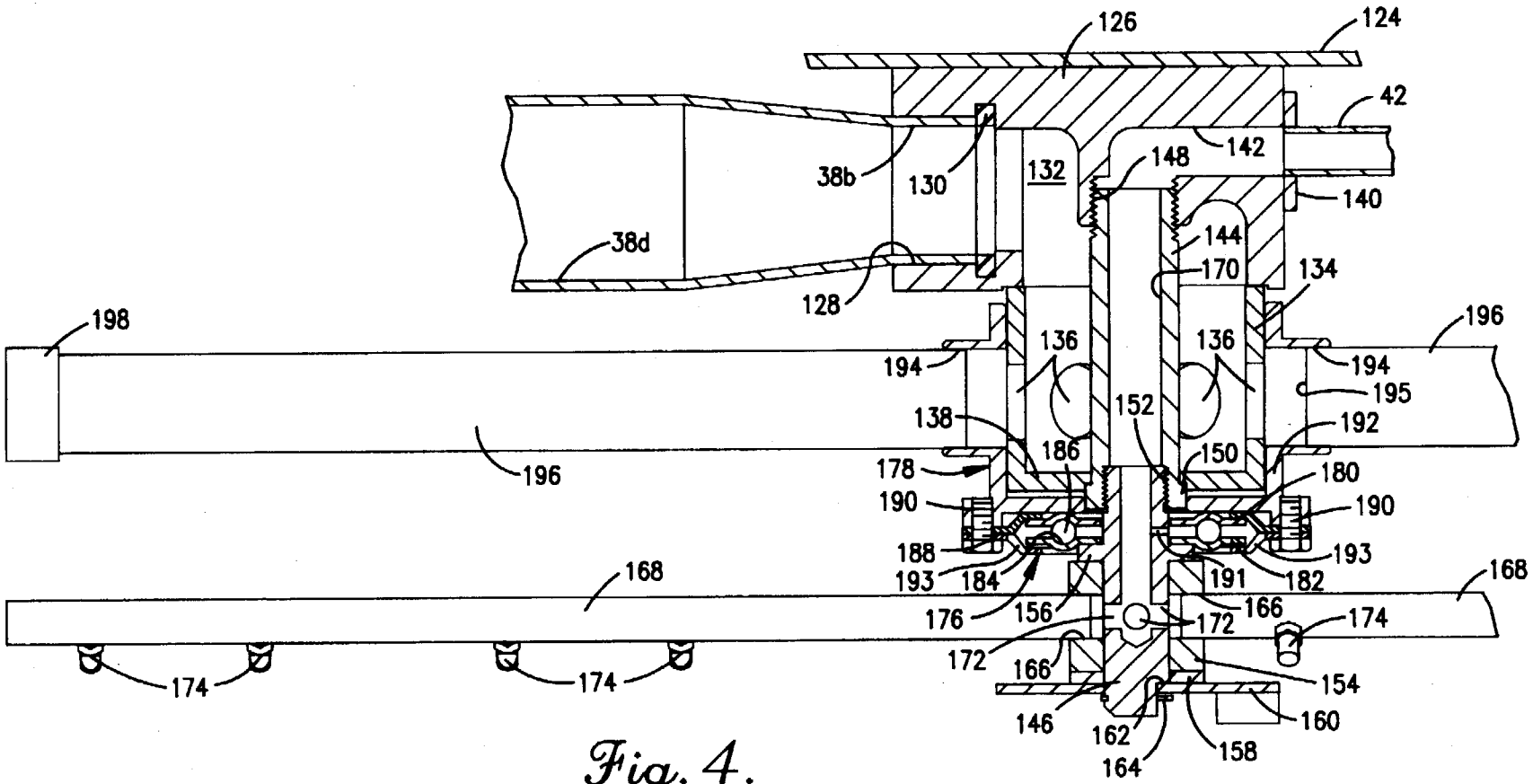
FIG. 4 is a fragmentary sectional view on an enlarged scale taken generally along line 4—4 of FIG. 2 in the direction of the arrows.

FIG. 4 depicts an upper spray assembly which has a construction substantially identical to but inverted relative to the lower spray assembly shown in FIG. 5. The vertical conduit portion **38*d* through which the wash water is pumped turns sidewardly (see FIG. 1) near a top panel 124 of the cabinet. An upper spray base 126 is mounted to the underside of the top panel 124. A wash water inlet 128 is formed in the spray base 126. The end of conduit 38 is reduced in diameter at 38*b*, and the reduced diameter end 38*b* is fitted in the inlet 128 and butted against an O-ring 130 secured in the spray base. The inlet 128 extends to a chamber 132 formed in the spray base 126**.

A dome or drum 134 is secured to the underside of the manifold block 126. The drum 134 is hollow and has a cylindrical wall which presents four discharge ports 136. The ports 136 provide for a sideward discharge of the wash water from the drum 134. The drum 134 has a circular end panel 138 on its lower end.

The conduit 42 which supplies clean rinse water has a flange 140 on its end. The flange 140 is bolted or otherwise secured to the spray base 126 with the rinse water supply pipe 42 in alignment with a rinse water inlet 142 formed in the spray base. A vertical conduit is formed by a pipe 144 and a spindle 146. The pipe 144 is threaded at 148 to a boss formed within the spray base 126. The pipe 144 extends through the end panel 138 and is provided on its lower end with a flange 150 which seats in a counter bore area of the end opening in the panel 138. This secures the drum 134 to the spray base 126.

The drum 134, pipe 144 and spindle 146 are all centered on a common vertical axis which is coincident with the axis of the lower spray assembly shown in FIG. 5. The spindle 146 has a threaded connection at 152 with the lower end of pipe 144. An upper rinse spray assembly has a hub 154 which is mounted to turn on the spindle 146. The spindle 146 has a radial lip or collar 156 against which the hub 154 is fitted. A flat washer 158 is fitted on the spindle 146 against the bottom face of the hub 154. A retainer plate 160 is likewise fitted on the lower end of the spindle and seats against a shoulder 162. A retaining clip 164 is snapped into a groove near the bottom end of the spindle 146 to hold the retainer 160, the washer 158, and the hub 154 on the spindle.

The hub 154 has two radial passages 166 which receive spray pipes or arms 168 which apply the rinse spray from above the wash compartment of the machine. The pipe 144 and spindle 146 form a conduit which presents a flow passage 170 which receives rinse water from the inlet 142. Four laterally extending discharge ports 172 are provided near the end of the flow passage 170, and the ports 172 align with the passages 166 as the hub 154 turns on the spindle 146. Rinse liquid is thus supplied to each of the spray arms 168 as the upper rinse spray assembly rotates. Each spray arm 168 has a plurality of spaced apart spray nozzles 174 which apply the rinse liquid in the form of a spray.

A ball bearing assembly 176 provides rotative support for a hub 178 which extends around the upper drum 134. The bearing assembly 176 has a construction identical to that of the lower bearing assembly 96, and it has the same advantages described previously for the lower bearing assembly. A pair of annular bearing races 180 and 182 present a track 184 between them. The track 184 receives a plurality of balls 186. A two-piece shell 188 holds the races 180 and 182 together at their outer edges and is connected with the hub 178 by a plurality of screws 190. The lower race 182 rests on top of the collar 156 so that the hub 178 is mounted to rotate about the central vertical axis of the drum 134, pipe 144 and spindle 146. A port 191 is formed in the wall of spindle 146 to direct water from passage 170 into the area between the races 180 and 182 for flushing of contaminants from the bearing 176. Outlet openings 193 are formed in the lower part of the shell 188 to allow the water pressure to be relieved and debris to be flushed from the bearing 176.

The hub 178 has a wall 192 which fits around the drum 134. The wall 192 has an outwardly extending center portion presenting an annular channel 195 on the inside of the hub wall. The channel 195 aligns with ports 136. Internally threaded openings 194 are formed through the center portion of the hub wall and communicate with the channel 195. The hub and channel construction is the same as depicted in FIG. 7 for the hub 112 (although the upper hub 178 is inverted relative to the lower hub 112).

Figure 2:
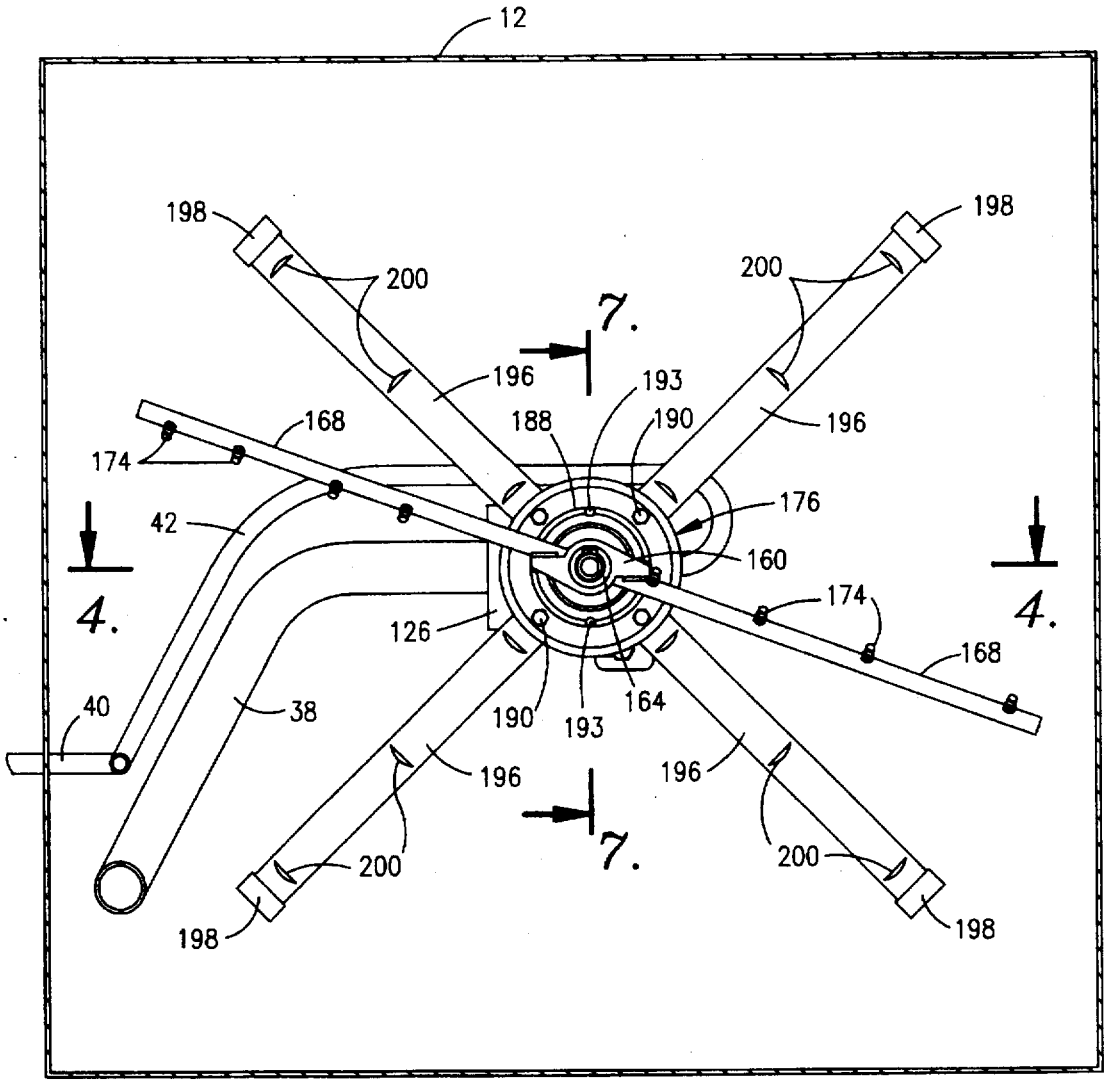
FIG. 2 is a sectional view taken generally along line 2—2 of FIG. 1 in the direction of the arrows.

A spray arm 196 is threaded into (or otherwise connected with) each opening 194. Each arm 196 is provided with an end cap 198 on its outer end. Each arm 196 is also provided with a plurality of spaced apart openings 200 (see FIG. 2) through which the wash water discharges downwardly in a spray pattern toward the dishes in the wash compartment.

Figure 6:
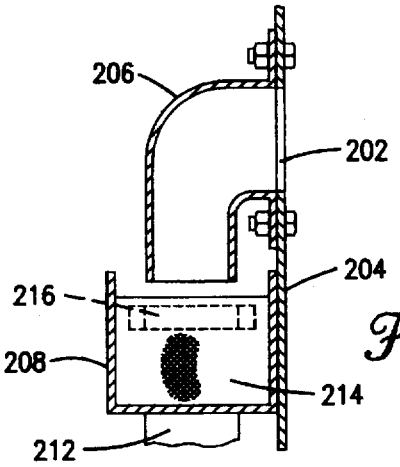
FIG. 6 is a fragmentary sectional view on an enlarged scale taken generally along line 6—6 of FIG. 3 in the direction of the arrows.

The machine has an overflow system which is best shown in FIGS. 3 and 6. An overflow opening 202 (FIG. 6) is formed through one side panel 204 of the machine at a location above the screens 24. A fitting 206 is bolted to the outside surface of panel 204 to register with the opening 202. The bottom end of fitting 206 directs the overflow water into a scrap box 208 which is secured to the panel 204. The bottom of the scrap box 208 has a drain opening 210 from which drain piping 212 extends to the building drain system. A screen tray 214 fits closely in the scrap box to collect debris that overflows with the water through the overflow opening 202. The tray 214 is equipped with a handle 216 to facilitate its removal from the scrap box 208 for cleaning of debris from the screen tray 214.

In operation of the machine 10, a rack 20 containing dirty dishes is loaded into the wash compartment 16, and the hood (not shown) is closed to enclose the dishes. A wash cycle of the machine is then initiated, and a rinse cycle follows after the wash cycle has ended. The rack 20 is then removed from the wash compartment.

During the wash cycle, the pump 26 is energized to pump water from the sump 22 through conduits 34, 36 and 38. From conduit 38, the wash water enters the spray bases 46 and 126 and flows through their interior chambers to the insides of the drums 56 and 134. The water flows sidewardly into the spray arms 118 and 196 directly through the discharge openings 58 and 136 in the walls of the drums. The channels 117 and 195 on the inside of the hubs receive the water from ports 58 and 136 and provide a space for the water to collect before it enters the wash arms 118 and 196. Without the channels, the water pressure would be applied so abruptly and forcefully to the hubs that they could be displaced from the drums they surround. Thus, the channels 117 and 195 are important aspects of the spray assemblies.

The water pressure of the incoming water causes the hubs 112 and 178 to rotate about the drums, thus rotating the spray arms 118 and 196. As the hubs rotate, the discharge openings 58 and 136 register in succession with the inlet ends of the spray arms in order to supply wash water to the spray arms. The lower spray arms 118 discharge the wash water upwardly toward the overlying rack 20, while the upper spray arms 196 discharge the wash water downwardly toward the underlying rack 20. The water drains into the sump 22.

It is an important feature of the invention that the wash water sprayed from the top spray arms is sprayed at a greater pressure than the wash water from the lower spray arms. As best shown in FIG. 1, the water in conduit 36 enters the horizontal portion 38*c* of conduit 38 at an angle causing the water to flow upwardly into conduit portion 38*d*. This directs the water to the top spray base 126 at a substantial pressure. The back pressure in the horizontal conduit portion 38*c* is applied to the lower spray base 46. Because of the angle of approach of conduit 36, there is a higher pressure applied to the top spray base than to the bottom spray base. Consequently, food scraps and the like on the dishware is for the most part dislodged and forced generally downwardly toward the wash water tank rather than being sprayed upwardly where it could adhere to the walls and ceiling of the hood.

At the end of the wash cycle, the pump 26 is deenergized, and a conventional solenoid valve (not shown) is opened in the conduit 40 to supply clean incoming city water to conduits 42 and 44. This rinse water is delivered to the two spray bases 46 and 126 and passes through the flow passages 78 and 170, through the ports 92 and 172 to the rinse spray arms 90 and 168. The water pressure causes the hubs 80 and 154 to rotate on the spindles 68 and 146. The rotating rinse arms 90 and 168 then apply a rinse spray toward the dish rack from the nozzles 94 and 174. Both the wash water and the rinse water drain into the sump 22 which collects the water so that it can be used again during the next wash cycle.

When rinse water is added to the machine, the water level rises to a level above the bottom edge of the overflow opening 202. Consequently, some of the water overflows through opening 202 during each application of rinse water. The overflowing water carries with it any floating debris, and this debris is collected on the screen tray 214 which can be periodically removed and cleaned. The water which reaches the scrap box 208 is drained away. The screens 24 collect debris which sinks, so debris from the dishware is not cycled through the wash water pump.

Clean rinse water in passages 78 and 170 flows through the ports 111 and 191 to flush out the bearings 96 and 176, with the water and any debris in the bearings discharging through openings 113 and 193. The location of the openings 113 and 193 outwardly of the outside edges of the bearing races is important in achieving thorough and effective flushing of the bearings. The bearings are exposed to any foreign material which may enter with the dishware and which may tend to clog up or corrode the bearings and degrade their performance. Accordingly, dislodging of such materials from the bearings is necessary to a lengthy useful life of the bearings.

The spray assemblies can be quickly and easily disassembled for maintenance work. The hub 80 of the lower rinse spray assembly can simply be lifted off of the spindle 68, and the bearing 96 together with the hub 112 and spray arms 116 can then be lifted upwardly for removal. The end caps 120 can be removed so that the insides of the spray arms 118 can be cleaned of any debris that may accumulate in them. If desired, the spindle 68 can be threaded out of pipe 66, and pipe 66 can be unthreaded from the spray base 46. This also releases the drum 56 to provide access to the chamber 54.

The upper spray assembly can be disassembled in a similar manner. The retainer plate 160 is keyed to the spindle 146 and has finger grips which facilitate turning it to thread the spindle out of pipe 144. The spindle 146, hub 154, arms 168, washer 158 and retainer plate 160 can then be removed as a single assembly. The wash arm assembly is released at the same time and can be slipped off of the drum 134. Pipe 144 can be threaded out of the spray base 126 to release drum 134.

The components of the spray assemblies can be reassembled by reversing the procedure used to remove them. Many of the components of the upper and lower spray assemblies are interchangeable. For example, the upper and lower wash spray arm assemblies are identical and can be interchanged when they are reassembled after the maintenance operations have been carried out. This is important because the operators of this type of machinery generally have a relatively low level of skill and may not be able to differentiate between the upper and lower arm assemblies.

It is also noteworthy that the clean rinse water is segregated from the wash water which is recycled water that may be contaminated with food scraps and other debris. Keeping the wash water and rinse water segregated assures that the final rinse will be applied with clean water to assure that the dishware is thoroughly rinsed before it is removed from the wash compartment.

The manner in which the bearing assemblies 96 and 176 are constructed makes the bearings especially advantageous for use in this application. The bearings are relatively simple and yet function effectively to allow the wash arms to freely turn. The bearings also have a lengthy useful life, in large part because they are thoroughly flushed during each rinse cycle.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. In a washing machine of the type used to wash dishes and the like, a spray assembly comprising:

a generally cylindrical drum on the machine having a hollow interior for receiving liquid to be sprayed, said drum having a substantially vertical axis and a plurality of ports for discharging the liquid laterally;

a vertical support centered on the axis of said drum;

a hub carrying a plurality of radially extending spray arms each adapted to spray the liquid, said hub having an interior channel communicating with open ends of said spray arms and receiving incoming liquid from said ports;

bearing means for supporting said hub for rotation around said drum, said bearing means being arranged to situate said channel at a location to receive liquid discharging laterally through said ports and to transfer the liquid to said spray arms as the hub rotates around said drum, said bearing means comprising a pair of annular races spaced vertically apart and extending around said support, said races having outer edges and opposing faces presenting an annular track centered on said axis;

a plurality of ball elements in said track providing for relative rotation of said races; and a shell holding said races together adjacent said outer edges and connected to said hub.

2. A spray assembly as set forth in claim 1, including means for introducing clean liquid between said races and an opening in said shell located outwardly of said outer edges of the races for discharging the liquid introduced between the races and any debris entrained by the liquid flowing between the races.

3. A spray assembly as set forth in claim 1, including:

a generally vertical conduit on the machine extending through the interior of said drum and centered on said axis to provide said vertical support;

a spindle located exteriorly of said drum and forming an extension of said conduit, said spindle and conduit cooperating to present a flow path for a second liquid which is segregated from the first mentioned liquid sprayed by said spray arms;

a radially extending lip projecting from said spindle on which said bearing means rests; and a spray assembly supported on said spindle for rotation and operable upon rotation to spray the second liquid supplied thereto through said flow path.

4. In a washing machine of the type used to wash dishes and the like, a spray assembly comprising:

a generally cylindrical drum on the machine having a hollow interior for receiving liquid to be sprayed, said drum having a plurality of ports for discharging the liquid laterally;

a hub carrying a plurality of radially extending spray arms each adapted to spray the liquid, said hub having an interior channel communicating with open ends of said spray arms and receiving incoming liquid from said ports;

bearing means for supporting said hub for rotation around said drum, said bearing means being arranged to situate said channel at a location to receive liquid discharging laterally through said ports and to transfer the liquid to said spray arms as the hub rotates around said drum;

a substantially vertical axis of said drum;

a generally vertical conduit on the machine extending through the interior of said drum and centered on said axis;

a spindle located exteriorly of said drum and forming an extension of said conduit, said spindle and conduit cooperating to present a flow path for a second liquid which is segregated from the first mentioned liquid sprayed by said spray arms;

a radially extending lip projecting from said spindle on which said bearing means rests; and a spray assembly supported on said spindle for rotation and operable upon rotation to spray the second liquid supplied thereto through said flow path.

5. A spray arm assembly as set forth in claim 4, wherein said bearing comprises:

a pair of annular races spaced vertically apart and extending around said spindle with one of the races on said lip, said races having opposite faces presenting an annular track centered on said axis;

a plurality of ball elements in said track providing for relative rotation of said races; and a shell holding said races together and connected to said hub.

6. A spray assembly as set forth in claim 5, including a port in said spindle located to direct the second liquid between said races and an opening in said shell for discharging the liquid flowing between the races and any debris the liquid picks up.

7. In a washing machine of the type receiving a supply of wash liquid for washing objects such as dishes and a supply of rinse liquid for rinsing the objects, a spray arrangement comprising:

a spray base on the machine having a first inlet connected with one of said liquid supplies and a second inlet connected with the other of said liquid supplies;

a generally cylindrical drum mounted to said spray base and having a substantially vertical axis, said drum having a hollow interior communicating with said first inlet to receive liquid therefrom and port means for discharging the liquid received from said first inlet;

a hub supported for rotation on said drum about said axis, said hub presenting a channel therein aligned on the said port means to collect liquid passing through said port means;

a plurality of spray arms carried on said hub and extending laterally therefrom, each arm having an inlet end communicating with said channel to receive liquid therefrom and each arm having means for spraying liquid toward the objects when said hub rotates;

a substantially vertical conduit mounted to said spray base and communicating with said second inlet to receive liquid therefrom, said conduit extending through the interior of said drum generally along said axis;

a spray assembly supported on said conduit for rotation about said axis, said spray assembly having spray arm means for receiving liquid from said conduit and spraying the liquid toward the objects when said spray assembly rotate a spindle located exteriorly of said drum and forming an extension of said conduit, said conduit and spindle presenting a flow path for the liquid applied to said second inlet;

at least one port in said spindle for discharging the liquid therefrom, said spray assembly being supported on said spindle for rotation with said spray arm means disposed to receive the liquid discharging through said port when the spray assembly rotates; and a bearing supporting said hub on said spindle for rotation, said bearing comprising a pair of annular races spaced vertically apart and extending around said spindle, said races having opposing faces presenting an annular track centered on said axis;

a plurality of ball elements in said track providing for relative rotation of said races; and a shell holding said races together and connected to said hub.

8. A spray assembly as set forth in claim 7, including a port in said spindle located to direct the second liquid between said races and an opening in said shell for discharging the liquid flowing between the races and any debris the liquid picks up.

9. A spray arrangement as set forth in claim 7, wherein:

said spindle presents a radially extending lip; and one of said bearing races is disposed on said lip.

10. A spray arrangement as set forth in claim 7, wherein:

said drum has a generally cylindrical wall;

said port means comprises a plurality of ports extending through said wall of the drum and oriented to discharge liquid laterally from the interior of the drum;

said hub has an interior channel aligned with said ports to receive liquid flowing therethrough; and said spray arms extend from said hub and have open inlet ends which communicate with said channel to receive liquid therefrom.

11. In a washing machine which washes and rinses objects such as dishes and which includes a cabinet presenting a compartment for receiving the objects and a tank for receiving liquid that has been sprayed in the compartment, a spray arrangement comprising:

top and bottom wash spray assemblies each including a plurality of spray arms adapted to spray wash liquid;

means for mounting said top and bottom wash spray assemblies on the cabinet at respective locations above and below the compartment for rotation about generally vertical axes with said spray arms thereof extending laterally and oriented to spray generally downwardly and upwardly, respectively;

top and bottom rinse spray assemblies each including a plurality of spray arms adapted to spray rinse liquid;

means for mounting said top and bottom rinse spray assemblies on the cabinet at respective locations above and below the compartment for rotation about generally vertical axes with said spray arms thereof extending laterally and oriented to spray generally downwardly and upwardly, respectively;

means for pumping liquid from the tank to said spray arms of both wash spray assemblies to spray wash liquid therefrom toward objects in the compartment, said liquid pumping means including means for supplying the liquid to said top wash spray assembly at a greater pressure than to said bottom wash spray assembly; and means for supplying clean rinse liquid to said spray arms of both rinse spray assemblies to spray rinse liquid therefrom toward objects in the compartment.

12. A spray arrangement as set forth in claim 11, wherein said top and bottom wash spray assemblies are interchangeable and are inverted relative to one another when mounted on the cabinet by said mounting means for the wash spray assemblies.

13. In a washing machine of the type used to wash objects such as dishes, a spray assembly comprising:

a drum on the machine having a substantially vertical axis, said drum presenting a hollow interior and a plurality of side discharge ports;

a conduit supported in extension through the interior of said drum along the axis thereof;

a spindle located exteriorly of said drum and forming an extension of said conduit, said conduit and spindle cooperating to provide a flow path for rinse liquid;

a rinse spray assembly mounted on said spindle for rotation and having a plurality of laterally extending spray pipes each communicating with said flow path to receive rinse liquid therefrom and each adapted to spray rinse liquid toward the objects when said rinse spray assembly rotates;

means for supplying clean rinse liquid to said flow path;

a hub carrying a plurality of spray arms each adapted to spray wash water;

a bearing connected with said hub and mounting said hub on said spindle for rotation about said drum axis with said spray arms extending laterally and communicating with said discharge ports of the drum to receive wash liquid from the interior of the drum and spray the wash liquid on the objects when said hub rotates; and means for supplying wash water to the interior of said drum.

14. In a washing machine for dishware having a cabinet presenting a wash compartment for receiving dishware to be washed and rinsed, a spray assembly for spraying wash water on the dishware, means for spraying clean rinse water on the dishware in the wash compartment following the spraying of wash water thereon, a sump underlying said wash compartment for collecting both the wash water and the rinse water sprayed on the dishware, and a pump for pumping water from the sump to the spray assembly, the improvement comprising:

screen means underlying said wash compartment to catch and collect debris in the water entering the sump;

an overflow opening on the cabinet receiving water and debris floating thereon when the water level in the wash compartment reaches the level of the overflow opening, said overflow opening being above said screen means to carry floating debris through the overflow opening with the overflowing water;

a scrap box on the cabinet having a drain opening for draining away water entering the scrap box;

means for directing water and floating debris into said scrap box when the water and debris passes through said overflow opening; and a screen in said scrap box for collecting the debris therein but allowing water to flow to said drain opening.

* * * * *